United States Patent [19]

Buss

[11] 4,392,030

[45] Jul. 5, 1983

[54] ADJUSTABLE ROTARY SWITCH

[75] Inventor: Gary L. Buss, Arden, N.C.

[73] Assignee: CTS Corporation, Elkhart, Ind.

[21] Appl. No.: 294,374

[22] Filed: Aug. 19, 1981

[51] Int. Cl.[3] ..... H01H 21/76

[52] U.S. Cl. ..... 200/11 R; 200/11 G

[58] Field of Search ..... 200/11 R, 11 A, 11 D, 200/, 11 DA, 11 G, 11 J, 11 TW, 38 B, 302

[56] References Cited

U.S. PATENT DOCUMENTS

| | | | |
|---|---|---|---|
| 2,997,552 | 8/1961 | Silverschotz | 200/24 |
| 3,015,705 | 1/1962 | Dull | 200/11 G X |
| 3,594,527 | 7/1971 | Brant et al. | 200/11 G X |
| 3,819,886 | 6/1974 | Homan et al. | 200/38 B |
| 3,958,087 | 5/1976 | Mol et al. | 200/11 TW X |
| 4,163,879 | 8/1979 | Mayer et al. | 200/11 TW |
| 4,166,200 | 8/1979 | Reichen et al. | 200/11 R |
| 4,196,324 | 4/1980 | Kojima et al. | 200/11 DA |
| 4,212,000 | 7/1980 | Yamada | 340/347 P |
| 4,232,207 | 11/1980 | Kuhl | 200/11 R |

FOREIGN PATENT DOCUMENTS

| | | |
|---|---|---|
| 2152128 | 4/1973 | Fed. Rep. of Germany . |
| 2314277 | 10/1974 | Fed. Rep. of Germany . |

*Primary Examiner*—J. R. Scott

*Attorney, Agent, or Firm*—Larry J. Palguta; John A. Young

[57] ABSTRACT

An adjustable rotary switch (10) effects a high degree of switching accuracy between the switching circuit disposed in a printed circuit board (60) and the external switch actuating means attached to the shaft (80) of the rotary switch (10). The switch (10) includes an annular rotor (40) mounted on the shaft (80), the rotor (40) having multi-fingered contactors (50) mounted thereon for engagement with conductive paths (70) disposed in the printed circuit board (60). The shaft (80), rotor (40), and printed circuit board (60) are disposed within a rectangular housing (12) having an aperture (18) providing access to one end of the shaft, and a housing cover (14) having an aperture (15) journalling the other end of the shaft. After assembly of the switch, the housing (12) and shaft (80) may be held in a fixed position while an adjustment tool (30) rotates the rotor (40) to adjust the position of the contactors (50) relative to the shaft (80) and the conductive paths (70) of the printed circuit board (60). Alternatively, the adjustment tool (30) may be held still while the shaft (80) is rotated to effect a new positional relationship between the switch parts. After the switch parts are adjusted, the rotor (40) is secured to the shaft (80) by applying an adhesive, and then covers (22) are inserted in the openings (18, 20) in the housing (12).

7 Claims, 3 Drawing Figures

ADJUSTABLE ROTARY SWITCH

DESCRIPTION

1. Technical Field

The present invention relates to a rotary switch construction which can be adjusted to effect a high degree of switching accuracy between the switching circuits contained in the insulating substrate and the external circuit selection means, thereby producing the high degree of switching accuracy necessary for use of the switch with a microprocessor receiving coded inputs from the rotary switch construction.

2. Background Art

Rotary switches have gained considerable acceptability for a wide variety of uses and functions. Rotary switch constructions utilizing a printed circuit board therein have appeared in a wide variety of configurations, including those designs wherein the printed circuit board contains a plurality of conductive paths arranged in concentric rings thereon. A rotary switch containing a printed circuit board for connection with a digital encoder is described in U.S. Pat. No. 3,333,068 entitled "Printed-Circuit Digital Encoder With Improved Printed Circuit and Movable Contact Structure", issued on July 25, 1967. The patent describes a boat shaped housing having an annular rotor mounted therein with rake type contactors mounted on the rotor for contact with the conductive portions of the printed circuit board positioned in facing relationship. The rotor has gear teeth about the circumference thereof engaging complementary gear teeth that drive the rotor. However, this is not an adjustable rotary switch which will allow positioning of the contacts in relation to the conductive paths of the circuit board. U.S. Pat. No. 3,496,313, entitled "Adjustable Rotary Switch", issued on Feb. 17, 1970, describes a rotor which is attached to the shaft by a bolt which can be loosened in order that the rotor may be repositioned. The rotor has teeth which serve as a means for driving the rotor. The switch has brushes for contact with conducting regions on the face of a commutator, and the switch is designed for continuous rotation. U.S. Pat. No. 4,038,504, entitled "Rotary, Printed Circuit Wafer Switch and Method For Adjusting", and issued on July 26, 1977, describes a snap-in bushing utilized to hold the rotor, bushing, and printed circuit board in assembled relationship. A washer secures the rotor frictionally to the bushing for rotation therewith. Although the switch is adjustable, the switch may not be adjusted to effect the finite positioning between the contactors and the conductive portions of the printed circuit board, and the contactors are of the curved type which wear and result in less accurate circuit switching. U.S. Pat. No. 4,131,771, entitled "Rotary Switch With Spaced Circuit Boards and Discrete Contacts on Rotor Opposite Faces Electrically Insulated From Furthermost Board", issued on Dec. 26, 1978, describes a rotary switch having a plurality of brush contactors for engagement with conductive portions of the printed circuit board. The rotor has serrated portions about its circumference which engage a detent in the housing. However, this switch is not adjustable and is designed for continuous annular rotation.

DISCLOSURE OF INVENTION

The present invention is an adjustable rotary switch suitable for use as a coding device that interfaces with a microprocessor. An annular insulative rotor having a plurality of rake-type contactors mounted thereon is mounted on an annular metallic shaft by force fitting the shaft through a square aperture in the rotor. The metallic shaft is inserted through an aperture in an insulating substrate so that the plurality of rake-type contactors are in opposed facing relationship with conductive paths disposed in the insulating substrate. The shaft, insulating substrate, and rotor are disposed within a housing and a housing cover. The housing cover provides an opening in which one end of the shaft is journalled. That end of the shaft includes a flat portion for attachment of an external switch actuating means thereto. A circular boss on one surface of the annular rotor is received in a circular groove disposed in the interior of the housing body. The housing body has an aperture providing access to a slotted end of the shaft, and another housing aperture or tool opening is disposed adjacent to the circumference of the rotor. The rotor has serrated teeth located in a portion of the circumference. The rotary switch may be adjusted to obtain a highly accurate positioning between the switching circuit in the insulating substrate and the switch actuating means attached to the shaft. Adjustment of the switch parts is accomplished by fixedly positioning the switch housing, attaching a pointer tool onto the flat portion of the one end of the shaft and utilizing the tool for fixedly positioning the shaft, and inserting an adjustment tool through the tool opening in the housing for engagement with the serrated teeth of the annular rotor. The adjustment tool is rotated to effect rotation of the rotor and rake-type contactors relative to the fixedly positioned shaft, switching circuit, and housing; alternatively, the annular rotor may be held by the adjustment tool in a fixed position, while the pointer tool is utilized to rotate the shaft and thereby alter the positional relationship of the rotor and contactors relative to the switching circuit. These adjustments effect the highly accurate and finite positioning of the contactors mounted on the annular rotor in relation to the switching circuit contained in the printed circuit board, all in relation with the exterior actuation means attached to the other end of the shaft. This achieves a high degree of switching accuracy which is necessary for producing a proper coded output as the actuation means is utilized to operatively rotate the rake-type contactors, and the coded output being communicated through external circuit means connected to a microprocessor.

BEST MODE FOR CARRYING OUT THE INVENTION

Figure 1:
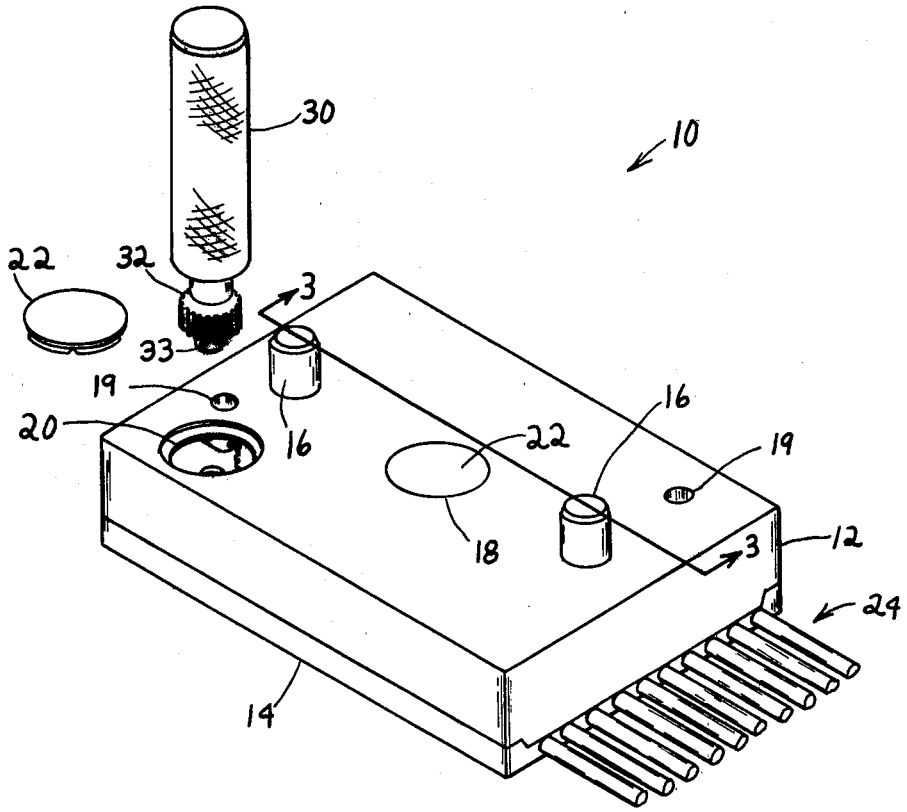
FIG. 1 is a perspective view of the switch mechanism and the wiring means leading to the microprocessor, and the adjustment tool for adjusting the switch parts.

Referring now to the drawings, FIG. 1 shows a perspective view of the underside of the switch designated generally by numeral 10. The adjustable rotary switch comprises a generally rectangular housing body 12 mated with a complementary housing cover 14. Extending from the housing body are two positioning posts 16 between which is located an access opening 18. Disposed in one corner of the housing body 12 is adjustment tool access opening 20, both access openings 18 and 20 normally closed by plugs 22. The plug for the adjustment tool access opening 20 has been removed in order to illustrate the placement of the adjustment tool 30 into the adjustment access opening 20. The housing body and housing cover are sealed together by ultrasonic welding of the parts or by any adhesive suitable for bonding resin materials. From one end of the housing body and housing cover, extend a plurality of conductors designated generally by numeral 24. The plurality of conductors 24 are connected to the input of a microprocessor or any other device utilized for receiving the coded output of the adjustable rotary switch 10.

Figure 3:
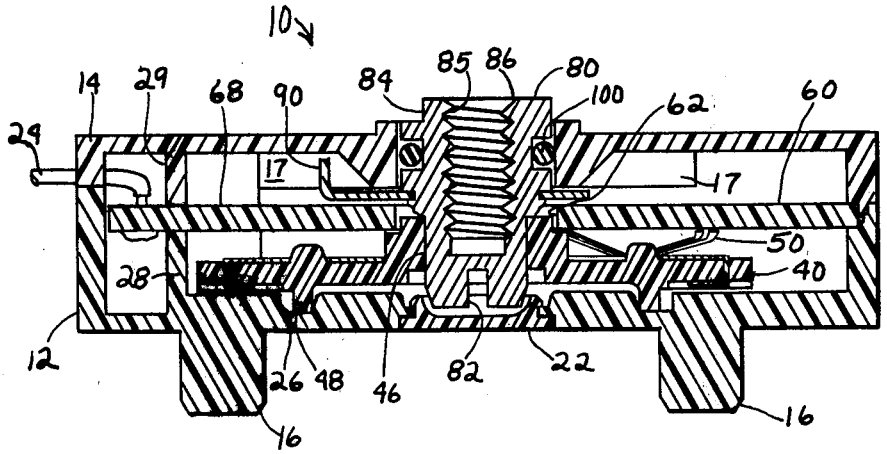
FIG. 3 is a section view of the adjustable rotary switch taken along view lines 3—3 of FIG. 1.
Figure 2:
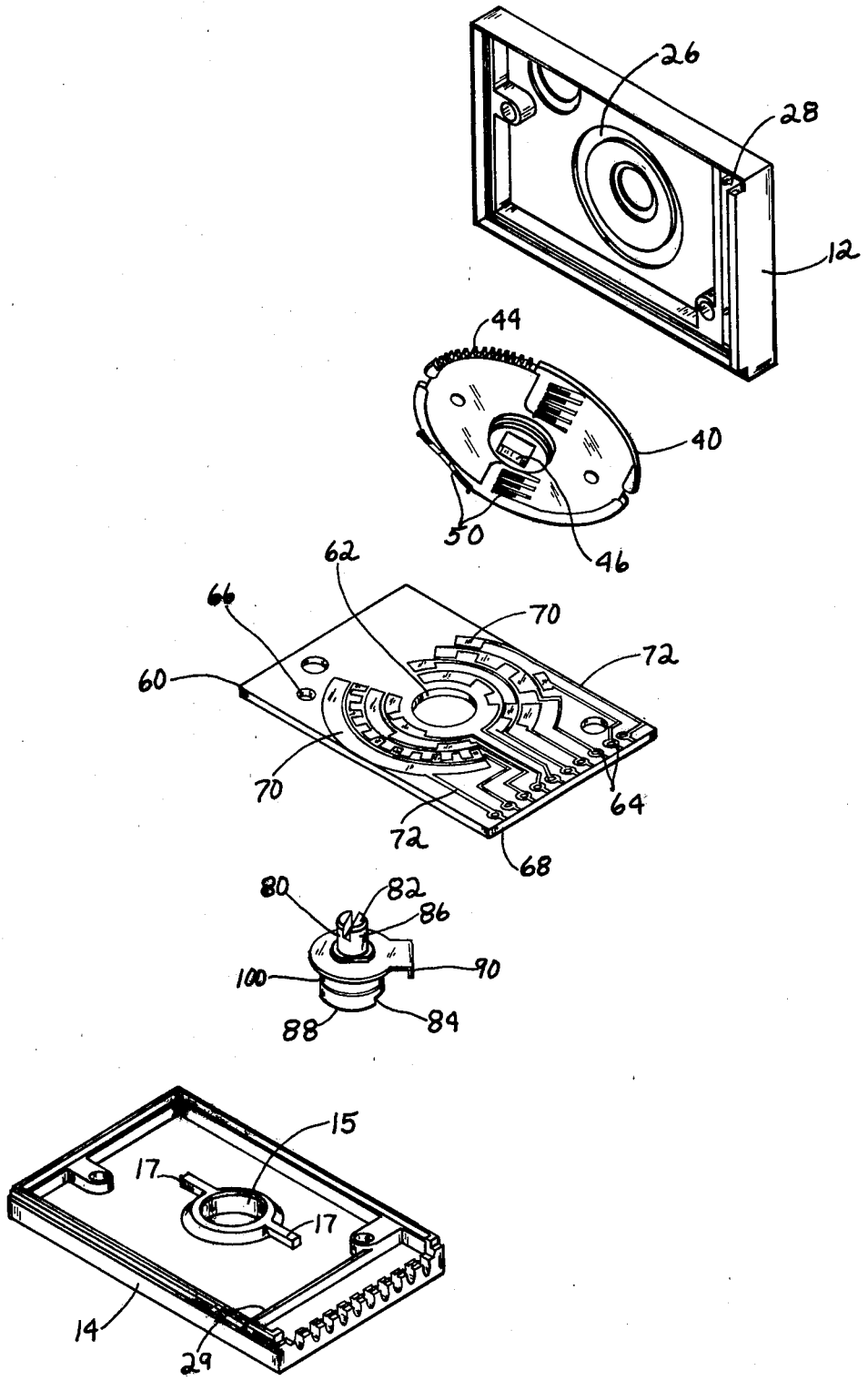
FIG. 2 is an exploded view of the adjustable rotary switch.

Referring now to FIGS. 2 and 3, the interior of the housing body includes an annular groove 26 disposed concentrically about the access opening 18, and a support wall 28. Rotor 40 is made of an insulative thermoplastic resin material and a portion of the circumference of the rotor consists of serrated teeth 44. The rotor has a noncircular shaft opening 46 disposed at the center of the rotor, and mounted on one face of the rotor is a plurality of rake contactors 50. The rake contactors 50 are stamped from metal sheeting and are secured to the face of the rotor by any conventional means such as heat staking. Located in opposed facing relationship with the plurality of rake contactors 50 is insulative substrate 60 having a switching circuit consisting of a plurality of conductive paths 70 disposed in the substrate. The substrate has a shaft opening 62 and a plurality of aligned terminal openings 64 located at one end of the board 60. The plurality of conductive paths 70 connect with respective conductive portions 72 terminating at the plurality of terminal openings 64, so that the exterior conductors 24 may be connected to selected conductive paths by soldering the conductors 24 to openings 64. Located in one corner of the insulative substrate 60 is tool positioning hole 66. The hole receives an end of the adjustment tool 30 when the tool 30 is inserted through the adjustment tool access opening 20, so that the adjustment tool may be firmly positioned while parts of the rotary switch are being positioned.

A metallic shaft 80 has a slot 82 on one end of the shaft, and on the other end 88 of the shaft has an actuation lever flat 84. Mounted on one end of the shaft 80 is metallic stop device 90, which serves as a stop to limit rotation of the moveable parts of the adjustable rotary switch. The shaft end 86 is inserted through the opening 62 and force fitted into the noncircular opening 46 of the rotor 40. The shaft 80 positions the plurality of rake contactors in opposed facing relationship with the conductive paths 70 of the insulative body 60, so that when the shaft 80 is rotated, the rotor and rake type contactors 50 rotate therewith and the rake-type contactors engage selected paths in different ones of the concentric rings of conductive paths to effect a coded output through the external circuits. The shaft 80 has a sealing ring 100 fitting into a groove in the shaft 80.

The housing cover 14 is generally rectangular in shape and encloses one end of the housing body 12 when the two parts are sealed together. Centrally located in the housing cover 14, is aperture 15 through which extends the lower portion of the shaft 80. Formed integrally with the housing cover 14 are projection stops 17 and support wall 29 (FIG. 2). One end of the shaft 80 is journalled in the aperture 15, and the seal 100 effectively seals the opening so that exterior contaminants may not enter into the interior of the switch 10.

Referring now in FIG. 3, the rotor 40 has an annular boss 48 extending from one side thereof which mates with the groove 26 in the housing body 12.

The adjustable rotary switch 10 is assembled by first inserting the shaft end 88 into the aperture 15 of the cover 14, positioning the insulative substrate 60 on the cover, and then force fitting the noncircular opening 46 of the rotor 80 about the shaft end 86, with the rake type contactors 50 being positioned in opposed facing relationship with conductive paths 70 in the insulative board 60. This subassembly is then mounted in the housing body such that the annular boss 48 is nested in the annular groove 26, and the board mounted in the housing with an end resting upon the housing wall 28. The housing cover 14 is mated with the housing body 12 such that the housing support wall 29 fits against the surface 68 of the insulative board 60, and the rotary stop 90 is positioned between the stop projections 17 so that the rotational range of the shaft 80 and rotor 40 attached thereto, is effectively limited by stop projections 17 to approximately 140°. The shaft 80 has a threaded opening 85 so that the actuation lever (not shown) attached to the end of the shaft may be secured thereto by a bolt.

Rake type contactors 50 were chosen because as they wear during the usage of the switch, the contact surface area of each contactor will remain the same and thereby maintain switching accuracy. If a curved type contactor were used, as the contactor wore down its surface area would increase, and result in a lesser degree of switching accuracy because the contact surface area is enlarged with wear life. Also important for the wear life and the switching accuracy of the rotary switch 10, is the type of insulative board 60 and conductive paths 70 utilized for these type of constructions. In order to produce a coded output utilized by a microprocessor, it is important that the rotary switch be designed so that it will have a high degree of switching accuracy and a long mechanical life. Substrates having conductive patterns flush with the surface of the substrate have been manufactured by pressing a metallic pattern into a glass epoxy laminated board. The problem created by this type of process is that as the operational temperature increases, the metal forces itself out of the board. Thus, the contactors do not wipe over a flush board and conductive metallic pattern, but strike the raised edges of the metallic pattern and wear down both the contactor and the conductive metallic pattern. The adjustable rotary switch of the present invention utilizes a flushed substrate, that is, a substrate having a surface flush with the surface of the metallic conductive pattern, the flushed substrate being suitable for mass production and having a long wear life, high operational temperature, and a flushed switch surface. Of course, the flushed or smooth surface is essential for long wear life and will maintain its structural integrity at high temperatures. This is accomplished by bonding the metallic conductive pattern to a substrate with a thick layer of solid, modified epoxy film such as American Cyanamid FM-1000. The metallic pattern is then pressed into the epoxy film as it is cured in a hot press. This produces a substrate having a conductive pattern disposed therein and flush with the surface of the substrate. If the metal pattern is too flimsy or delicate to be etched prior to being bonded to the substrate, then the metallic sheet will be bonded to the substrate by only partially curing the epoxy. The metal can then be etched or chemically milled and the assembly returned to the hot press to completely cure the epoxy. The flushed substrate produced by this method has a smooth surface with the conductive pattern disposed therein, and has proven superior to other methods for producing flushed substrates, such as those described in the *Ney Contact Manual,* by K. E. Pitney, published in 1975.

OPERATION

Once assembled, the adjustable rotary switch 10 may be adjusted so that the proper switch positioning necessary for producing a coded electrical output can be obtained. This is accomplished by inserting the adjustment tool 30 into the adjustment tool access opening 20 of the housing body 12. The adjustment tool 30 has teeth 32 which engage the serrated teeth 44 of the rotor 40. Tool end 33 is received in the tool positioning hole 66 in the board 60 in order that the tool may be stablized during adjustment of the switch parts. The switch body 12 may be held in a fixed position by inserting the body posts 16 into apertures in a fixture (not shown). A pointer tool (not shown) is attached to the lever flat 84. While the shaft 80 is held stationary by the pointer tool, the adjustment tool 30 is rotated to rotate the rotor 40 about the round shaft 80 force fitted into the noncircular opening 46. When the proper position of the rake type contactors 50 is accomplished relative to the board, such that the proper relationship is achieved between the conductive paths 70 of the switching circuit and the flat 84 on the shaft 80, an adhesive epoxy is applied through access hole 18 to the slot 82 of shaft 80. The epoxy runs out of the slot 82 and fills the voids between the shaft end 86 and the rotor opening 46. This adheres the rotor to the shaft so that there will not be any slippage and switching accuracy will be maintained.

Alternatively, the adjustment tool 30 may be held still to immobilize the rotor 40, and the pointer tool (not shown) attached to the lever flat 84 may be rotated to adjust the switch parts. A third method of adjusting the rotary switch parts comprises fixedly positioning the rotor 40 by holding the tool 30 stationary, and inserting a tool such as a screw driver into the slot 82 and rotating the shaft 80 to effect the adjustment.

It is important that the proper positional relationship be established between the flat 84 and the switching circuit in the board 60, because an adjustment lever (not shown) will be attached to the end of the shaft 80 having the flat 84, and this lever will be moved from one selected switching position to another. Each switching position selected by the user must produce the proper coded output from the switching circuit, the output being transmitted via wires 24 and external circuitry to a microprocessor. The microprocessor will them operatively effect the desired result.

The housing 12 is then sealed so that contaminants will not enter therein, by fitting the covers 22 over the access openings 18 and 20. The adjustable rotary switch may then be mounted via positioning posts 16 and other securement means utilizing through openings 19, and the not shown adjustment lever attached to the end of the shaft 80 having the flat 84.

INDUSTRIAL APPLICABILITY

The adjustable rotary switch of the present invention will produce a coded output suitable for processing by a microprocessor.

CONCLUSION

Although the present invention has been illustrated and described in connection with the example embodiment, it will be understood that this is illustrative of the invention, and it is by no means restrictive thereof. It is reasonably to be expected that those skilled in the art can make numerous revisions and additions of the invention and it is intended that such revisions and additions will be included within the scope of the following claims as equivalents of the invention.

I claim:

1. A rotary switch calibrated for accurately selecting any one of a plurality of combinations of external circuits connected to the switch, the combinations being made in accordance with a predetermined code, said rotary switch comprising a housing having one end open and a housing wall with a centrally disposed aperture and a noncentrally located opening therein, an insulating substrate having a plurality of electrical contact paths for effecting said code and arranged in multiple concentric rings in the surface thereof, the surfaces of said contact paths being flush with the surface of said insulating substrate, a rotor comprising an insulating annular body and having teeth means for calibration of said switch and located at a portion of the circumference of said rotor, contactor means having multiple rake contactors and secured to said rotor for engaging selected combinations of contact paths in different ones of said rings whereby rake contactor surface areas engaging said paths remain constant despite wear, shaft means mounted in said switch to preclude axial movement thereof and coupled to said rotor to support and position said rotor in relationship to said housing and insulating substrate having the contact paths therein, said shaft means having tool adjustment means at one end thereof, and a cover secured to said housing to enclose said open end and having a cover aperture therein, said shaft means journalled in said cover aperture, whereby said tool adjustment means is accessible through said centrally disposed aperture and said teeth means accessible through said noncentrally located opening for adjustable positioning of said rotor and contactor means relatively to said shaft means and contact paths prior to fixing said rotor to said shaft means to calibrate said switch and effect precise switching accuracy in the selection of a combination of said external circuits.

2. The rotary switch of claim 1, further comprising rotational stop means fixedly secured to said shaft means and complementary stop means within said housing whereby the rotational stop means and complementary stop means effectively limit the rotational range of said rotary switch.

3. The rotary switch of claim 1, further comprising sealing means disposed about said shaft means for effecting a seal between said cover and shaft means to prevent external contaminants from entering the interior of said rotary switch.

4. The rotary switch of claim 1, wherein the rotor has annular bearing means projecting from a side thereof and said housing has annular groove means disposed therein whereby said annular bearing means is received in said annular groove means.

5. The rotary switch in accordance with claim 1, further comprising a cover means for enclosing said centrally disposed aperture and opening disposed in said housing to prevent the entry of contaminants into the interior of said switch.

6. The rotary switch in accordance with claim 1, wherein said tool adjustment means comprises a slot for rotatably positioning the shaft means relative to the rotor coupled thereto.

7. The rotary switch in accordance with claim 1, wherein said shaft means includes a shoulder at one end thereof for the attachment of lever means to said shaft means.

* * * * *